US007228695B2

(12) United States Patent
Chida et al.

(10) Patent No.: US 7,228,695 B2
(45) Date of Patent: Jun. 12, 2007

(54) HEAT PUMP TYPE HOT WATER SUPPLY DEVICE

(75) Inventors: Kouji Chida, Shiga (JP); Shinichi Sakamoto, Shiga (JP)

(73) Assignee: Daikin Industries, Ltd., Osaka (JP)

( * ) Notice: Subject to any disclaimer, the term of this patent is extended or adjusted under 35 U.S.C. 154(b) by 558 days.

(21) Appl. No.: 10/495,364

(22) PCT Filed: Nov. 11, 2002

(86) PCT No.: PCT/JP02/11716

§ 371 (c)(1),
(2), (4) Date: May 12, 2004

(87) PCT Pub. No.: WO03/042606

PCT Pub. Date: May 22, 2003

(65) Prior Publication Data

US 2005/0111991 A1 May 26, 2005

(30) Foreign Application Priority Data

Nov. 13, 2001 (JP) ..... 2001-347571
Sep. 25, 2002 (JP) ..... 2002-278620

(51) Int. Cl.
*F25B 27/00* (2006.01)

(52) U.S. Cl. ..... 62/238.7; 237/8 C

(58) Field of Classification Search .... 62/238.6–238.7; 237/8 C

See application file for complete search history.

(56) References Cited

U.S. PATENT DOCUMENTS 3,926,008 A * 12/1975 Webber ..... 62/200
4,747,273 A * 5/1988 Cook et al. ..... 62/238.6
5,366,152 A * 11/1994 Gossi ..... 237/2 B

FOREIGN PATENT DOCUMENTS

| | | |
|---|---|---|
| JP | 57-210241 A | 12/1982 |
| JP | 59-12249 A | 1/1984 |
| JP | 59-97448 A | 6/1984 |
| JP | 60-114645 A | 6/1985 |

(Continued)

*Primary Examiner*—William E. Tapolcai
(74) *Attorney, Agent, or Firm*—Birch, Stewart, Kolasch & Birch, LLP

(57) ABSTRACT

A heat pump type hot water supplying apparatus includes a hot water reservoir tank (3) and a circulating path (12) for connecting a water intake port (10) formed at the bottom of the hot water reservoir tank (3) and a hot water inlet (11) formed at the upper portion of the hot water reservoir tank (3) to each other. A water circulating pump (13) and a heat exchanging path (14) are disposed on the circulating path (12). A boiling operation is performed for heating the heat exchanging path (14) by a heat pump type heating source, boiling water which has not been heated yet from the water intake port (10) and returning the heated water to the hot water inlet (11). A bypassing path (17) branched from the hot water inlet (11) and connected to the bottom of the hot water reservoir tank (3) is disposed on the circulating path (12). A freeze-proof operation by circulation is performed such that the water circulating pump (13) is driven and the water reserved in the hot water reservoir tank (3) is returned to the hot water reservoir tank (3) via the bypassing path (17).

10 Claims, 5 Drawing Sheets

FOREIGN PATENT DOCUMENTS

| | | | |
|---|---|---|---|
| JP | 61-130848 | U | 8/1986 |
| JP | 1-17016 | Y | 5/1989 |
| JP | 11-63661 | A | 3/1999 |
| JP | 2002-48399 | A | 2/2002 |
| JP | 2002-213821 | A | 7/2002 |

* cited by examiner

HEAT PUMP TYPE HOT WATER SUPPLY DEVICE

TECHNICAL FIELD

The present invention relates to a heat pump type hot water supplying apparatus.

BACKGROUND ART

As shown in FIG. 5, a heat pump type hot water supplying apparatus is generally provided with a tank unit 52 including a hot water reservoir tank 51 and a heat pump unit 54 including a water heat exchanger 53. A water intake port 55 formed at the bottom of the hot water reservoir tank 51 and a hot water inlet 56 formed at the upper portion of the hot water reservoir tank 51 are connected to each other through a circulating path 57, on which a water circulating pump 58 and a heat exchanging path 59 are disposed. In this case, the water heat exchanger 53 constitutes the heat exchanging path 59, which is heated by a heat pump type heating source. Specifically, a boiling operation is performed such that the water circulating pump 58 is driven, water which has not been heated yet is boiled by the heat exchanging path 59, and then, the heated water is returned to the hot water inlet 56.

Here, the heat pump unit 54 includes a compressor, an expansion valve and an evaporator in addition to the above-described water heat exchanger 53, although not shown, wherein the water heat exchanger 53 is allowed to function as a condenser by driving the compressor.

Problems to be Solved

However, if the boiling operation is stopped for a long period of time in the case where outside air is low in temperature, for example, in winter, there has been a fear that water through a pipeline (i.e., the circulating path 57) between the tank unit 52 and the heat pump unit 54 and inside of the water heat exchanger 53 constituting the heat exchanging path 59 may be frozen. In view of this, the compressor has not been driven, but only the water circulating pump 58 has been driven, so that a freeze-proof operation has been performed for circulating the water through the circulating path 57.

When the water through the circulating path 57 has been circulated, the water of a low temperature has flowed out into the circulating path 57 from the water intake port 55, and thus, the water which has remained at the low temperature has been returned into the hot water inlet 56.

In this case, a hot water outlet 60 is formed at the upper portion (i.e., the top) of the hot water reservoir tank 51, and thus, hot water is supplied to a kitchen or a bathroom through the hot water outlet 60. The hot water of a high temperature is reserved in the hot water reservoir tank 51. Therefore, if the water which remains at the low temperature is returned to the upper portion in the hot water reservoir tank 51, the temperature of the hot water of the high temperature reserved at the upper portion in the hot water reservoir tank 51 is decreased. As a consequence, the hot water to be supplied to the kitchen or the bathroom becomes low in temperature. In view of this, it has been necessary to perform the boiling operation for driving the compressor, thereby requiring excessive input energy for the purpose of the freeze-proofing, so as to cause an increase in power consumption.

The present invention has been accomplished to solve the above-described problems observed in the prior art. Therefore, an object of the present invention is to provide a heat pump type hot water supplying apparatus, in which a circulating path can be prevented from being frozen without the necessity of excessive input energy.

DISCLOSURE OF THE INVENTION

A heat pump type hot water supplying apparatus of a first aspect of the present invention supposes that the heat pump type hot water supplying apparatus includes a hot water reservoir tank 3, a circulating path 12 for connecting a water intake port 10 formed at the bottom of the hot water reservoir tank 3 and a hot water inlet 11 formed at the upper portion of the hot water reservoir tank 3 to each other, and a water circulating pump 13 and a heat exchanging path 14 which are disposed on the circulating path 12, in which a boiling operation is performed for heating the heat exchanging path 14 by a heat pump type heating source, boiling water which has not been heated yet from the water intake port 10 and returning the heated water to the hot water inlet 11.

A bypassing path 17 branched from the hot water inlet 11 and connected to the bottom of the hot water reservoir tank 3 is disposed on the circulating path 12; and a freeze-proof operation by circulation is performed such that the water reserved in the hot water reservoir tank 3 is allowed to flow from the water intake port 10 to the circulating path 12 by driving the water circulating pump 13, so as to be returned to the bottom of the hot water reservoir tank 3 via the bypassing path 17 in at least either one case of the case where an outside air temperature is a freeze-proof reference outside air temperature or lower and the case where the temperature of the water through the circulating path 12 is a freeze-proof reference temperature or lower.

In the heat pump type hot water supplying apparatus of the first aspect of the present invention, the water reserved in the hot water reservoir tank 3 is allowed to flow from the water intake port 10 to the circulating path 12, so as to be returned to the bottom of the hot water reservoir tank 3 via the bypassing path 17 in at least either one case of the case where the outside air temperature is the freeze-proof reference outside air temperature or lower and the case where the temperature of the water through the circulating path 12 is the freeze-proof reference temperature or lower.

At this time, as the freeze-proof reference outside air temperature can be set a temperature at which there is a fear that the circulating path 12 may be frozen if the outside air temperature becomes that temperature or lower. Furthermore, as the freeze-proof reference temperature can be set a temperature at which there is a fear that the circulating path 12 may be frozen if the temperature becomes that temperature or lower. Consequently, when the outside air temperature becomes the freeze-proof reference outside air temperature or lower, the water through the circulating path 12 can be circulated. Moreover, when the temperature of the water through the circulating path 12 becomes the freeze-proof reference temperature or lower, the water through the circulating path 12 can be circulated.

In other words, in the case where there is a fear of freezing, it is possible to prevent any freezing since the water through the circulating path 12 is circulated. At this time, the water through the circulating path 12 is returned onto the bottom side of the hot water reservoir tank, so that the water of a low temperature cannot be mixed with the hot water of a high temperature reserved at the upper portion of the hot water reservoir tank 3, thereby preventing any decrease in temperature of the hot water to be used.

Furthermore, in a heat pump type hot water supplying apparatus of a second aspect of the present invention, the freeze-proof operation by circulation is performed when the outside air temperature is the freeze-proof reference outside air temperature or lower and the temperature of the water through the circulating path 12 is the freeze-proof reference temperature or lower.

In the heat pump type hot water supplying apparatus of the second aspect of the present invention, the freeze-proof operation by circulation can be performed for circulating the water through the circulating path 12 when the outside air temperature is the freeze-proof reference outside air temperature or lower and the temperature of the water through the circulating path 12 is the freeze-proof reference temperature or lower.

That is to say, like the first aspect of the present invention, as the freeze-proof reference outside air temperature can be set a temperature at which there is a fear that the circulating path 12 may be frozen if the outside air temperature becomes that temperature or lower. Furthermore, as the freeze-proof reference temperature can be set a temperature at which there is a fear that the circulating path 12 may be frozen if the temperature becomes that temperature or lower.

When the temperature is set in the above-described manner, although the fear of freezing becomes high if the temperature of the outside air and the temperature of the water through the circulating path 12 become the above-described reference temperatures or lower, it is possible to securely prevent any freezing by the freeze-proof operation by circulation.

Moreover, in a heat pump type hot water supplying apparatus of a third aspect of the present invention, a freeze-proof operation by heating by the use of the heat pump type heating source is performed when the temperature of the water through the circulating path 12 is a low temperature reference value or lower, which is much lower than the freeze-proof reference temperature.

In the heat pump type hot water supplying apparatus of the third aspect of the present invention, when the temperature of the water through the circulating path 12 is very low with a fear of freezing, the water through the circulating path 12 can be warmed by the freeze-proof operation by heating by the use of the heat pump heating source. In this manner, it is possible to securely prevent any freezing.

Incidentally, although the water is normally returned to the hot water reservoir tank 3 not via the bypassing path 17 in the case of boiling by the use of the heat pump heating source, the water may be returned to the hot water reservoir tank 3 via the bypassing path 17.

Additionally, in a heat pump type hot water supplying apparatus of a fourth aspect of the present invention, a freeze-proof operation by heating by the use of the heat pump type heating source is performed when the temperature of the water through the circulating path 12 is a low temperature reference value or lower, which is much lower than the freeze-proof reference temperature after the freeze-proof operation by circulation is continued for a predetermined period of time.

In the heat pump type hot water supplying apparatus of the fourth aspect of the present invention, in the case where there remains a fear of freezing only by circulating the water through the circulating path 12 without heating the water through the circulating path 12, it is possible to securely prevent any freezing by the freeze-proof operation by heating by the use of the heat pump type heating source.

In addition, in a heat pump type hot water supplying apparatus of a fifth aspect of the present invention, the freeze-proof operation is stopped in at least either one case of the case where the outside air temperature is a freeze-proof releasing outside air temperature or higher which is higher than the freeze-proof reference outside air temperature and the case where the temperature of the water through the circulating path 12 is a freeze-proof releasing water inlet temperature or higher which is higher than the freeze-proof reference temperature.

In the heat pump type hot water supplying apparatus of the fifth aspect of the present invention, there is no fear of freezing when the outside air temperature is a freeze-proof releasing outside air temperature or higher which is higher than the freeze-proof reference outside air temperature and the temperature of the water through the circulating path 12 is a freeze-proof releasing water inlet temperature which is higher than the freeze-proof reference temperature. Therefore, in this state, it is possible to stop the freeze-proof operation. Consequently, it is possible to avoid an unnecessary freeze-proof operation.

Furthermore, in a heat pump type hot water supplying apparatus of a sixth aspect of the present invention, the freeze-proof operation is stopped in at least either one case of the case where the outside air temperature is a freeze-proof releasing outside air temperature or higher which is higher than the freeze-proof reference outside air temperature and the case where a predetermined period of time elapses after the temperature of the water through the circulating path 12 becomes a freeze-proof releasing temperature which is higher than the freeze-proof reference temperature.

In the heat pump type hot water supplying apparatus of the sixth aspect of the present invention, there is a high possibility of not freezing when a predetermined period of time elapses after the temperature of the water through the circulating path 12 becomes a freeze-proof releasing temperature which is higher than the freeze-proof reference temperature, thereby securely avoiding an unnecessary freeze-proof operation.

Moreover, in a heat pump type hot water supplying apparatus of a seventh aspect of the present invention, the freeze-proof reference temperature is a temperature with respect to a fore side of the heat exchanging path 14 on the circulating path 12.

In the heat pump type hot water supplying apparatus of the seventh aspect of the present invention, the freeze-proof operation refers to the temperature of the water on the fore side of the heat exchanging path 14 of the circulating path 12.

Additionally, in a heat pump type hot water supplying apparatus of an eighth aspect of the present invention, the freeze-proof reference temperature is a temperature with respect to a rear side of the heat exchanging path 14 on the circulating path 12.

In the heat pump type hot water supplying apparatus of the eighth aspect of the present invention, the freeze-proof operation refers to the temperature of the water on the rear side of the heat exchanging path 14 of the circulating path 12.

In addition, in a heat pump type hot water supplying apparatus of a ninth aspect of the present invention, the freeze-proof reference temperature is set by selecting one of the temperatures with respect to the fore and rear sides of the heat exchanging path 14 on the circulating path 12.

In the heat pump type hot water supplying apparatus of the ninth aspect of the present invention, the freeze-proof operation refers to the temperature selected from the temperatures of the water on the fore and rear sides of the heat exchanging path 14 of the circulating path 12.

Furthermore, in a heat pump type hot water supplying apparatus of a tenth aspect of the present invention, the freeze-proof reference temperature is temperatures with respect to the fore and rear sides of the heat exchanging path 14 on the circulating path 12.

In the heat pump type hot water supplying apparatus of the tenth aspect of the present invention, the freeze-proof operation refers to the temperatures of the water on the fore and rear sides of the heat exchanging path 14 of the circulating path 12.

In the heat pump type hot water supplying apparatus of the first aspect of the present invention, in the case where there is a fear that the inside of the water heat exchanger constituting the circulating path and the heat exchanging path may be frozen, it is possible to prevent any freezing since the water through the circulating path is circulated. At this time, the water through the circulating path is returned onto the bottom side of the hot water reservoir tank, so that the water of a low temperature cannot be mixed with the hot water of a high temperature reserved at the upper portion of the hot water reservoir tank, thereby preventing any decrease in temperature of the hot water to be used. Consequently, it is possible to contribute to power saving without requiring excessive input energy.

In the heat pump type hot water supplying apparatus of the second aspect of the present invention, in the case where there is the fear that the inside of the water heat exchanger constituting the circulating path and the heat exchanging path may be frozen, it is possible to securely prevent any freezing by circulating the water through the circulating path. In contrast, in the case where there is no fear of freezing, the freeze-proof operation by circulation is not performed, thereby contributing to reduction of a running cost.

In the heat pump type hot water supplying apparatus of the third or fourth aspect of the present invention, when the temperature of the water through the circulating path is very low with the fear of freezing, the freeze-proof operation by heating is performed, thereby securely preventing any freezing. Consequently, it is possible to securely prevent the circulating path or the like from being frozen, to stably perform a normal boiling operation thereafter, and to reserve the hot water of a high temperature in a desired quantity in the hot water reservoir tank 3. Moreover, it is possible to securely prevent any decrease in temperature of the hot water reserved in the hot water reservoir tank, so as to stably take out the hot water of a high temperature from the hot water reservoir tank.

In the heat pump type hot water supplying apparatus of the fifth or sixth aspect of the present invention, if there is no fear of freezing of the circulating path or the like, the freeze-proof operation can be stopped, thereby avoiding any unnecessary freeze-proof operation, so as to further save the power consumption. In addition, if there is the fear of freezing, it is possible to prevent any freezing by the freeze-proof operation.

In the heat pump type hot water supplying apparatus of the seventh aspect of the present invention, the freeze-proof operation refers to the temperature of the water on the fore side of the heat exchanging path of the circulating path. Consequently, it is possible to stably perform the freeze-proof operation even if there is the fear of freezing.

In the heat pump type hot water supplying apparatus of the eighth aspect of the present invention, the freeze-proof operation refers to the temperature of the water on the rear side of the heat exchanging path of the circulating path. The freeze-proof operation refers to the portion whose temperature possibly becomes lower after the water passes through the heat exchanging path, thereby enhancing the reliability of the start of the freeze-proof operation.

In the heat pump type hot water supplying apparatus of the ninth aspect of the present invention, the freeze-proof operation refers to the temperature of the water on the fore or rear side of the heat exchanging path, thereby easily determining the freeze-proof operation.

In the heat pump type hot water supplying apparatus of the tenth aspect of the present invention, the freeze-proof operation refers to the temperatures of the water on the fore and rear sides of the heat exchanging path of the circulating path. Consequently, it is possible to more stably perform the freeze-proof operation even if there is the fear of freezing.

BEST MODE CARRYING OUT THE INVENTION

A heat pump type hot water supplying apparatus in a preferred embodiment according to the present invention will be specifically described below in reference to the accompanying drawings.

Figure 1:
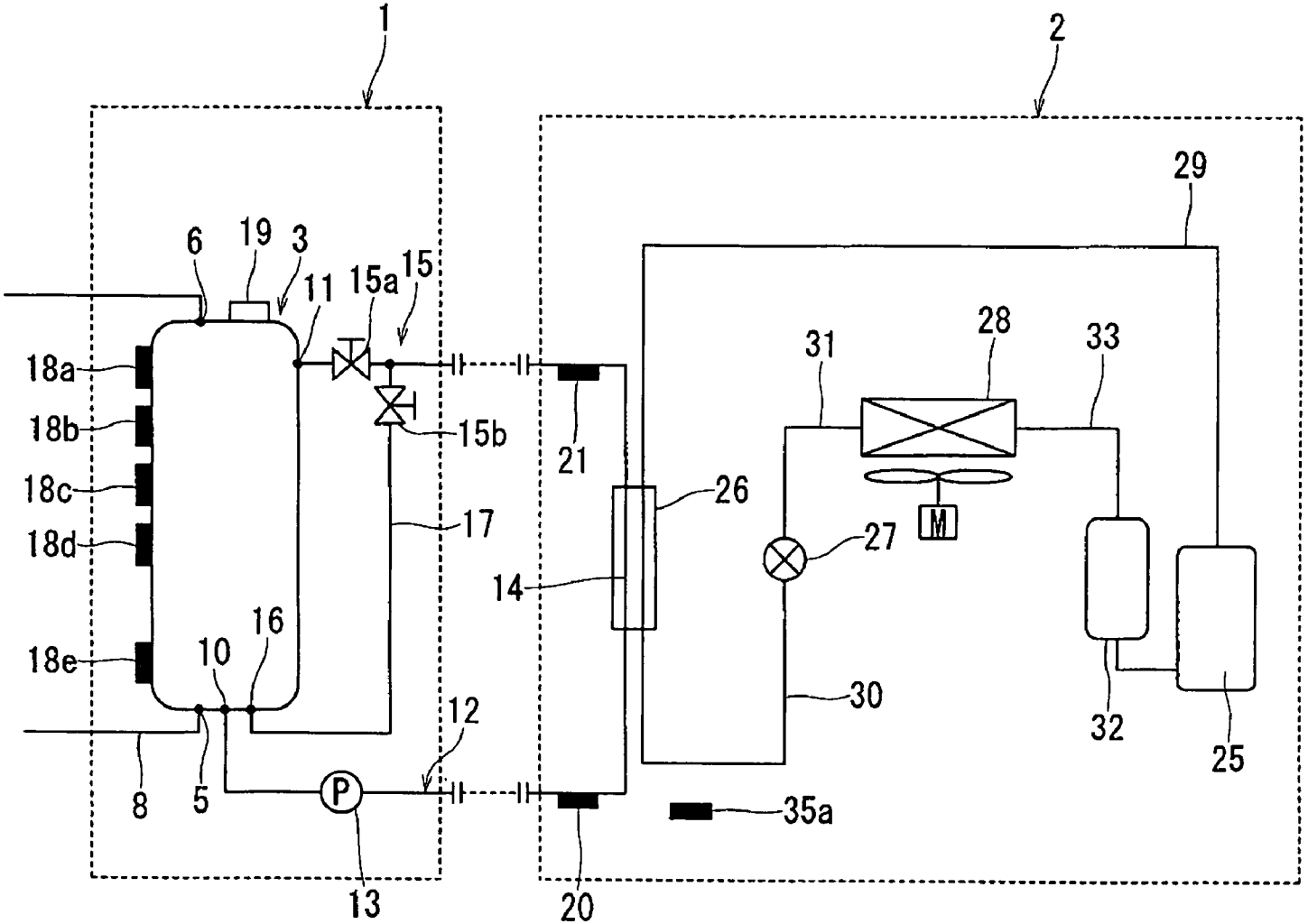
FIG. 1 is a schematic view showing a heat pump type hot water supplying apparatus in a preferred embodiment according to the present invention.

FIG. 1 is a schematic view showing a heat pump type hot water supplying apparatus in a preferred embodiment according to the present invention. The heat pump type hot water supplying apparatus is provided with a tank unit 1 and a heat source unit (i.e., a heat pump unit) 2, for heating water (hot water) reserved in the tank unit 1 by the use of the heat source unit 2.

The tank unit 1 includes a hot water reservoir tank 3. Hot water reserved in the hot water reservoir tank 3 is supplied to a bath or the like, although its illustration is omitted. Specifically, in the hot water reservoir tank 3, a water supplying port 5 is formed on the bottom wall and a hot water outlet 6 is formed on the upper wall. The water is supplied to the hot water reservoir tank 3 through the water supplying port 5, and then, hot water of a high temperature is taken out through the hot water outlet 6. Furthermore, in the hot water reservoir tank 3, a water intake port 10 is opened on the bottom wall and a hot water inlet 11 is opened at the upper portion on a side wall (i.e., a circumferential wall). The water intake port 10 and the hot water inlet 11 are connected to each other via a circulating path 12. On the circulating path 12 are disposed a water circulating pump 13 and a heat exchanging path 14. Here, a water supplying channel 8 is connected to the water supplying port 5.

A bypassing path 17 connected onto the bottom side of the hot water reservoir tank 3 is branched from the hot water inlet 11 on the circulating path 12. Furthermore, switch means 15 is constituted of a first opening/closing valve (i.e., a two-way valve) 15*a* disposed on the circulating path 12 on the side of the hot water inlet 11 beyond the branching portion of the bypassing path 17 and a second opening/closing valve (i.e., a two-way valve) 15*b* disposed on the bypassing path 17. The flowing direction of the circulating path 12 is varied by switching the switch means 15.

That is to say, the water (i.e., the hot water) taken from the water intake port 10 into the circulating path 12 flows on the circulating path 12, and then, is returned from the hot water inlet 11 to the hot water reservoir tank 3 by opening the first opening/closing valve 15*a* while closing the second opening/closing valve 15*b*. In contrast, the water (i.e., the hot water) taken from the water intake port 10 into the circulating path 12 flows on the circulating path 12 into the bypassing path 17, and then, is returned to the hot water reservoir tank 3 via a connecting port 16 formed on the bottom wall of the hot water reservoir tank 3 from the bypassing path 17 in a bypassing operation by opening the second opening/closing valve 15*b* while closing the first opening/closing valve 15*a*.

Incidentally, the switch means 15 may be constituted of three-way valves. Moreover, in the case where the bypassing path 17 is connected onto the bottom side of the hot water reservoir tank 3, it may be connected not directly to the connecting port 16 formed on the bottom wall of the hot water reservoir tank 3 but upstream of the water circulating pump 13 on the circulating path 12, that is, between the water intake port 10 and the water circulating pump 13.

The hot water reservoir tank 3 is provided with four detectors 18*a*, 18*b*, 18*c* and 18*d*, each of which detects the residual quantity of the hot water, arranged in predetermined pitches in a vertical direction, and one detector 18*e* for detecting the temperature of the water to be supplied. Additionally, a temperature sensor (i.e., a protector) 19 is disposed on the upper wall of the hot water reservoir tank 3. Each of the above-described detectors 18*a*, 18*b*, 18*c*, 18*d* and 18*e* and temperature sensor 19 consists of, for example, a thermistor.

In addition, on the circulating path 12, a water intake thermistor 20 is disposed upstream of the heat exchanging path 14, and further, a hot water outlet thermistor 21 is disposed downstream of the heat exchanging path 14.

Next, the heat source unit (i.e., the heat pump unit) 2 is provided with a refrigerant circuit. The refrigerant circuit is constituted of a compressor 25, a water heat exchanger 26 constituting the heat exchanging path 14, a motor-operated expansion valve (i.e., a pressure reducing mechanism) 27 and an air heat exchanger (i.e., an evaporator) 28, which are connected in sequence. In other words, a discharge pipeline 29 of the compressor 25 is connected to the water heat exchanger 26; the water heat exchanger 26 and the motor-operated expansion valve 27 are connected to each other via a refrigerant passage 30; the motor-operated expansion valve 27 and the evaporator 28 are connected to each other via another refrigerant passage 31; and the evaporator 28 and the compressor 25 are connected to each other via a further refrigerant passage 33, in which an accumulator 32 is interposed. Consequently, when the compressor 25 is driven, the water heat exchanger 26 functions as a condenser, so as to heat the water flowing on the heat exchanging path 14, as described later.

Figure 2:
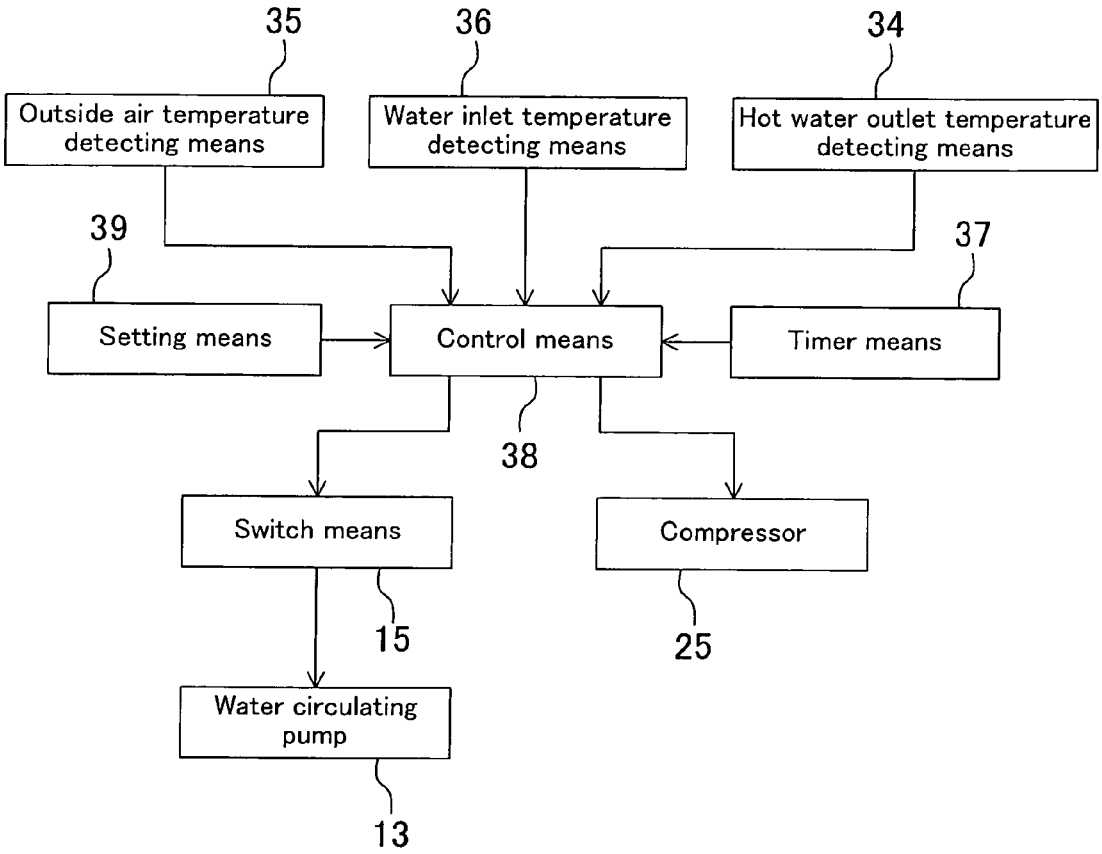
FIG. 2 is a schematic block diagram illustrating a control unit in the heat pump type hot water supplying apparatus.

As illustrated in FIG. 2, a control unit in the heat pump type hot water supplying apparatus includes outside air temperature detecting means 35, water inlet temperature detecting means 36, hot water outlet temperature detecting means 34, timer means 37 and control means 38 which receives data (i.e., numeric values) output from each of the detecting means 34, 35, 36 and 37. Here, the control means 38 may be constituted of, for example, a microcomputer.

In this case, the outside air temperature detecting means 35 includes an outside air thermistor 35*a*, as shown in FIG. 1; the water inlet temperature detecting means 36 includes the water intake thermistor 20; and the hot water outlet temperature detecting means 34 includes the hot water outlet thermistor 21. In other words, the outside air temperature detecting means 35 detects the temperature of the outside air; the water inlet temperature detecting means 36 detects the temperature of the heat exchanging path 14 on the fore side on (i.e., upstream of) the circulating path 12; and the hot water outlet temperature detecting means 34 detects the temperature of the heat exchanging path 14 on the rear side on (i.e., downstream of) the circulating path 12. The resultant detection values are input into the control means 38.

The control means 38 contains therein a freeze-proof reference outside air temperature, a freeze-proof reference temperature and the like. Here, the freeze-proof reference outside air temperature signifies a temperature at which the circulating path 12 may possibly be frozen in the case where the outside air temperature becomes the freeze-proof reference outside air temperature or lower. The freeze-proof reference temperature includes a freeze-proof reference water inlet temperature and a freeze-proof reference hot water outlet temperature. The freeze-proof reference water inlet temperature signifies a temperature at which the circulating path 12 may possibly be frozen in the case where a water inlet temperature (a temperature of the heat exchanging path 14 on the fore side on the circulating path 12) becomes this temperature or lower. The freeze-proof reference hot water outlet temperature signifies a temperature at which the circulating path 12 may possibly be frozen in the case where a hot water outlet temperature (a temperature of the heat exchanging path 14 on the rear side on the circulating path 12) becomes this temperature or lower.

Setting means 39 (see FIG. 2) sets the freeze-proof reference outside air temperature and the freeze-proof reference temperature (i.e., the freeze-proof reference water inlet temperature and the freeze-proof reference hot water outlet temperature). Here, the freeze-proof reference hot water outlet temperature is set with respect to the water of a low temperature, which has not been heated yet, and therefore, it is low (for example, about 3° C.).

The control means 38 compares the detected outside air temperature with the freeze-proof reference outside air temperature, and further, compares the detected water temperature on the circulating path 12 with the freeze-proof reference temperature. When the detected outside air temperature is the freeze-proof reference outside air temperature or lower or the detected temperature is the freeze-proof reference temperature or lower, the switch means 15 is switched, so that the pump 13 is driven in the state in which a bypassing operation can be performed. In this manner, the water (i.e., the hot water) on the circulating path 12 from the water intake port 10 flows into the bypassing path 17 through the circulating path 12, and thus, the bypassing operation (i.e., a freeze-proof operation by circulation) is performed to return the water to the hot water reservoir tank 3 from the connecting port 16 formed on the bottom wall of the hot water reservoir tank 3.

The above-described setting means 39 sets a low temperature reference value, which is set much lower than the freeze-proof reference temperature, a freeze-proof releasing outside air temperature higher than the freeze-proof reference outside air temperature, and a freeze-proof releasing temperature higher than the freeze-proof reference temperature. The control means 38 receives these low temperature reference value, freeze-proof releasing outside air temperature and freeze-proof releasing temperature.

Incidentally, the low temperature reference values include a reference value corresponding to a water inlet temperature and a reference value corresponding to a hot water outlet temperature. Moreover, the freeze-proof releasing temperatures include a freeze-proof releasing water inlet temperature corresponding to the water inlet temperature and a freeze-proof releasing hot water outlet temperature corresponding to the hot water outlet temperature.

The control means 38 compares the detected temperature (i.e., the water inlet temperature and/or the hot water outlet temperature) with the low temperature reference value. When the detected temperature is the low temperature reference value or lower, the compressor 25 is driven to perform the freeze-proof operation by heating, which is also referred to a boiling operation. Furthermore, the control means 38 compares the detected outside air temperature with the freeze-proof releasing outside air temperature or the like. When the outside air temperature is the freeze-proof releasing outside air temperature or higher, the above-described freeze-proof operation by circulation or freeze-proof operation by heating is stopped.

Subsequently, a description will be given below of the operation of the above-described heat pump type hot water supplying apparatus.

The compressor 25 is driven, and further, the water circulating pump 13 is driven (i.e., operated). And then, the reserved water (i.e., the reserved hot water) flows from the water intake port 10 formed at the bottom of the hot water reservoir tank 3, and then, flows through the heat exchanging path 14 on the circulating path 12. At this time, the hot water is heated (i.e., boiled) by the water heat exchanger 26, and then, is returned to the upper portion of the hot water reservoir tank 3 through the hot water inlet 11. The operation is continued, so that the hot water is reserved in the hot water reservoir tank 3. In this case, if the temperature of the boiled hot water, which is detected by the hot water outlet thermistor 21, is a predetermined temperature (for example, 85° C.) or lower, which has been set in advance, the switch means 15 is switched, thereby leading to the bypassing operation (i.e., the freeze-proof operation by circulation), in which the hot water flows in the bypassing path 17. In the meantime, if the temperature exceeds the predetermined temperature, the switch means 15 may be switched, thereby leading to a normal operation, in which the hot water does not flow in the bypassing path 17. Incidentally, since the night-time charge is set lower than the daytime charge in the current energy charge system, the boiling operation is performed during midnight when the energy charge is low. In this way, it is preferable that the cost reduction should be achieved.

Next, one control method in the heat pump type hot water supplying apparatus in the case where the normal boiling operation is stopped will be explained below in reference to a flowchart illustrated in FIG. 3.

In step S1, it is determined as to whether or not the outside air temperature is the freeze-proof reference outside air temperature (for example, 3° C.) or lower and the water inlet temperature is the freeze-proof reference water inlet temperature (for example, 3° C.) or lower. If the temperatures are not lower, the stop state is continued as it is. In contrast, if the temperatures are lower, the control routine proceeds to step S2, in which a freeze-proof mode (1) is started. Here, the freeze-proof mode (1) is a mode in which the switch means 15 is switched to the state in which the bypassing operation can be performed, so as to drive the water circulating pump 13. At this time, the compressor 25 is not driven. As a consequence, in the freeze-proof mode (1), the temperature of the outside air is decreased, and further, the temperature of the water on the circulating path 12 is decreased, thereby causing a fear that the circulating path 12 may be frozen. At this time, the freeze-proof operation by circulation is performed for circulating the water on the circulating path 12, thus preventing any freezing.

Thereafter, the control routine proceeds to step S3, in which it is determined as to whether or not the freeze-proof mode (1) is released. That is to say, it is determined as to whether the outside air temperature is the freeze-proof releasing outside air temperature (for example, 6° C.) or higher, which is higher by a predetermined value than the freeze-proof reference outside air temperature, or the water inlet temperature is the freeze-proof releasing water inlet temperature (for example, 6° C.) or higher, which is higher by a predetermined value than the freeze-proof reference water inlet temperature. If either one temperature is higher, the control routine proceeds to step S4, in which the freeze-proof mode is released. In other words, the water circulating pump 13 is stopped, thereby stopping the bypassing operation. In contrast, in the case where the freeze-proof mode (1) is not released in step S3, that is, in the case where the outside air temperature is not the freeze-proof releasing outside air temperature or higher and the water inlet temperature is not the freeze-proof releasing water inlet temperature or higher, the control routine proceeds to step S5.

In step S5, it is determined as to whether or not the water inlet temperature is the low temperature reference value (for example, 1° C.) or lower and the freeze-proof mode (1) is continued for a predetermined period of time (for example, 30 min.) or longer. The continuation time of the freeze-proof mode (1) is measured by the timer means 37. Specifically, if the water inlet temperature is the low temperature reference value or lower irrespective of the continuation of the freeze-proof mode (1) for the predetermined period of time, the control routine proceeds to step S6, in which a freeze-proof mode (2) is started. In contrast, if it is determined in step S5 that the water inlet temperature exceeds the low temperature reference value irrespective of the continuation of the freeze-proof mode (1) for the predetermined period of time, the control routine returns to step S3.

Here, the freeze-proof mode (2) signifies a normal boiling operation mode, in which the switch means 15 is switched so as to drive the compressor 25 in such a manner as to return the hot water on the circulating path 12 from the hot water inlet 11 to the hot water reservoir tank 3. Consequently, in the freeze-proof mode (2), the freeze-proof operation by heating can be achieved for boiling the water (which has not been heated yet) on the circulating path 12 from the water intake port 10 through the heat exchanging path 14 so as to return the hot water from the hot water inlet 11 to the hot water reservoir tank 3, thereby securely preventing the freezing of the circulating path 12. Furthermore, since the boiled hot water is supplied from the hot water inlet 11 to the hot water reservoir tank 3, it is possible to prevent any decrease in temperature of the hot-water on the side of the use, which is taken out through the hot water outlet 6.

After the freeze-proof mode (2) has been started, the control routine proceeds to step S7, in which it is determined as to whether the outside air temperature is the freeze-proof releasing outside air temperature (for example, 6° C.) or higher, which is higher by the predetermined value than the freeze-proof reference outside air temperature, or the water inlet temperature is the freeze-proof releasing water inlet temperature (for example, 6° C.) or higher, which is higher by the predetermined value than the freeze-proof reference water inlet temperature, like in step S3. In other words, it is determined as to whether or not the freeze-proof mode (2) is released. If it is determined that the freeze-proof mode (2) is not released, the freeze-proof mode (2) is further continued. In contrast, if it is determined that the freeze-proof mode (2) is released, the control routine proceeds to step S4, in which the freeze-proof mode (2) is released, and then, the control routine returns to step S1.

In this manner, if the water on the circulating path 12 is made to be circulated and heated by the use of the heat exchanging path 14 under the condition that there is the fear that the circulating path 12 may be frozen, the freezing can be prevented. Since the water of the low temperature is not returned to the upper portion of the hot water reservoir tank 3 even if the water is not heated by the use of the heat exchanging path 14, the water of the low temperature cannot be mixed with the hot water of the high temperature reserved at the upper portion of the hot water reservoir tank 3. As a result, it is possible to stably use the hot water of the high temperature without decreasing the temperature of the hot water to be taken out through the hot water outlet 6. That is to say, the temperature of the hot water to be used cannot be decreased even if the bypassing operation (i.e., the freeze-proof operation by circulation) is performed, thereby obviating the unnecessary boiling operation, so as to save energy consumption. Furthermore, without any fear of freezing, it is possible to stop the freeze-proof operation by circulation and the freeze-proof operation by heating, thereby avoiding the unnecessary operation.

Figure 4:
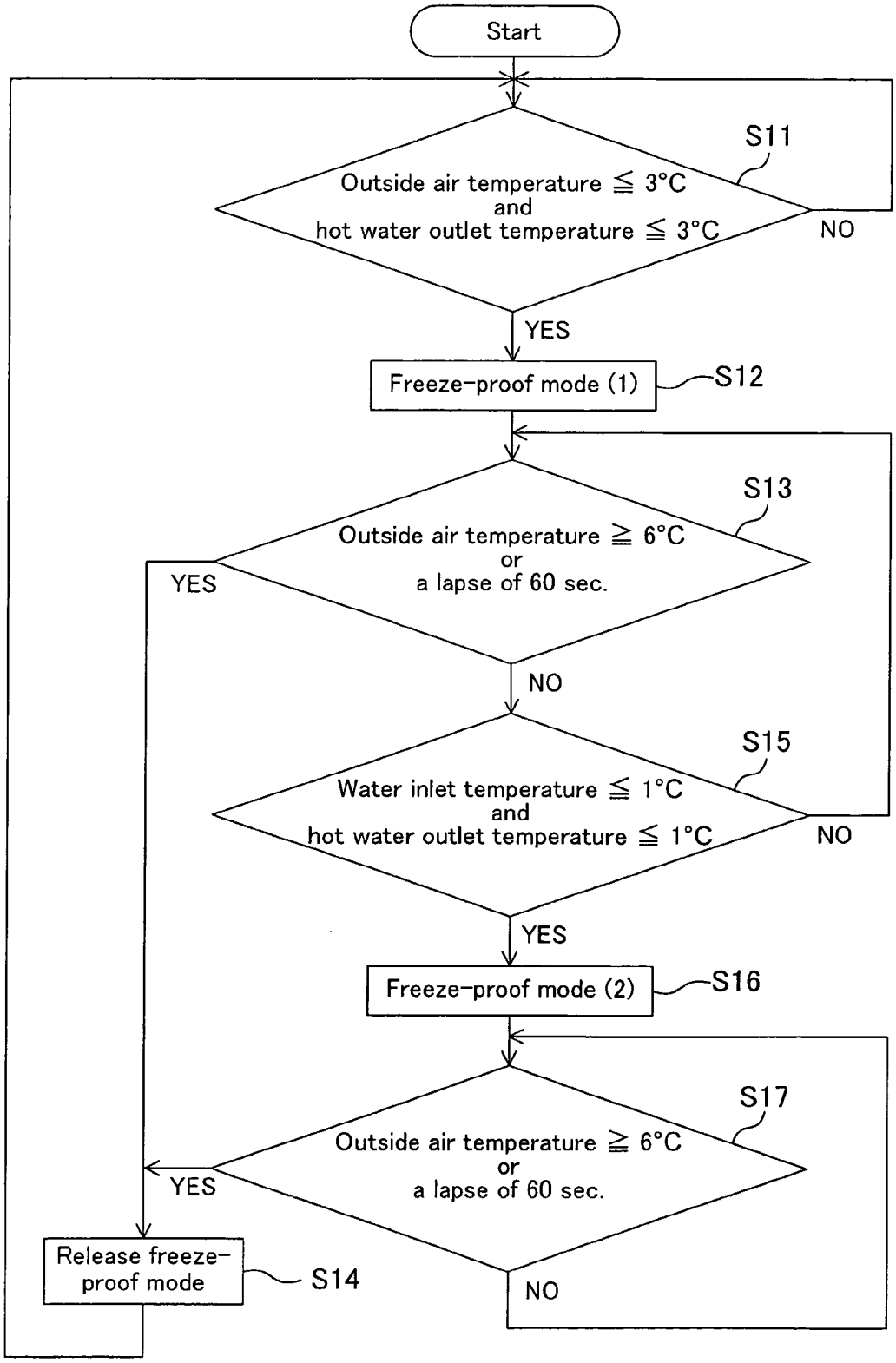
FIG. 4 is a flowchart illustrating another operation control in the heat pump type hot water supplying apparatus.
Figure 5:
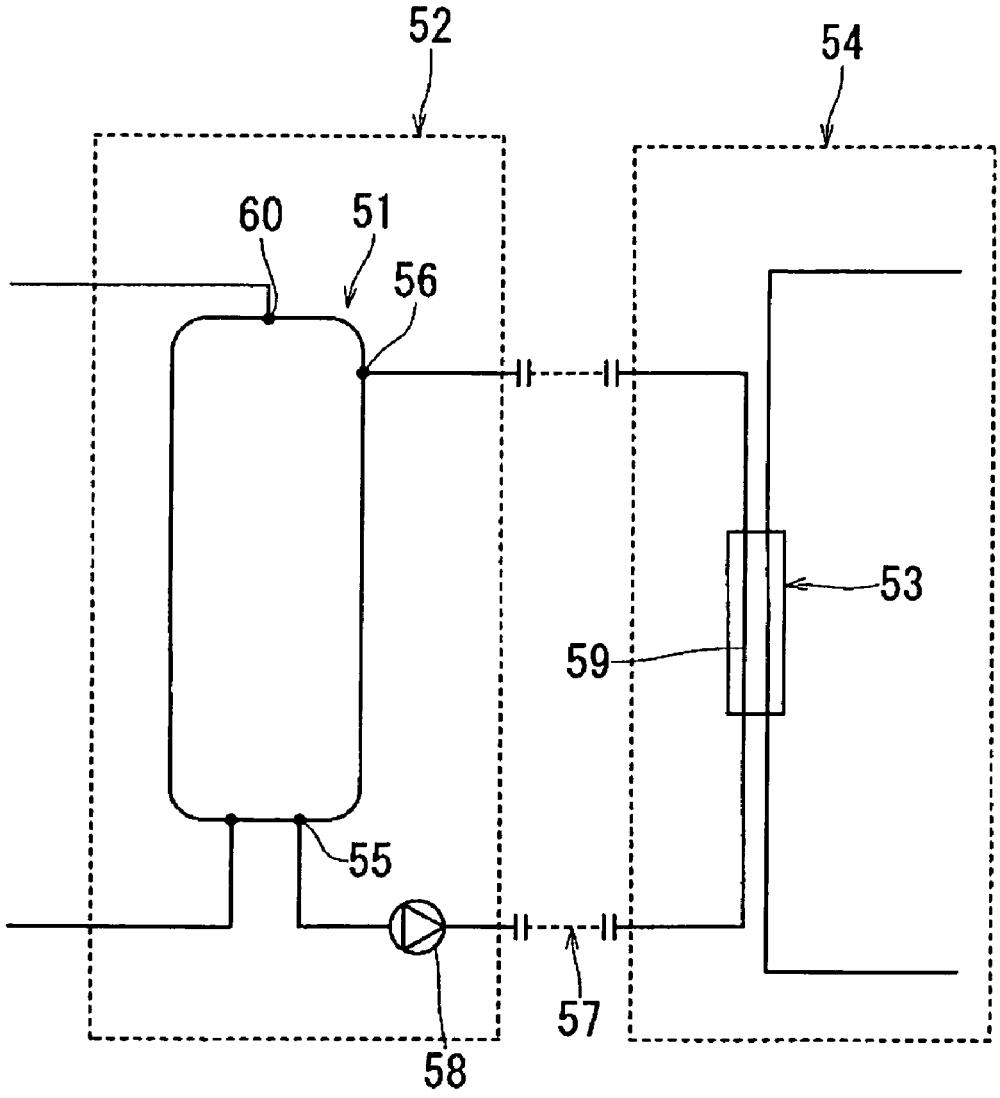
FIG. 5 is a schematic view showing a heat pump type hot water supplying apparatus in the prior art.

Otherwise, another control method may be carried out in accordance with a flowchart illustrated in FIG. 4. In this case, in step S11, it is determined as to whether or not the outside air temperature is the freeze-proof reference outside air temperature (for example, 3° C.) or lower and the hot water outlet temperature is the freeze-proof reference hot water outlet temperature (for example, 3° C.) or lower. If the temperatures are not lower, the stop state is continued as it is. In contrast, if the temperatures are lower, the control routine proceeds to step S12, in which the freeze-proof mode (1) (i.e., the mode in which the water is circulated through the bypassing path 17) is started. As a consequence, in the freeze-proof mode (1), the temperature of the outside air is decreased, and further, the temperature of the water on the circulating path 12 is decreased, thereby causing the fear that the circulating path 12 may be frozen. At this time, the freeze-proof operation by circulation is performed for circulating the water on the circulating path 12, thus preventing any freezing.

Thereafter, the control routine proceeds to step S13, in which it is determined as to whether or not the freeze-proof mode (1) is released. That is to say, it is determined as to whether the outside air temperature is the freeze-proof releasing outside air temperature (for example, 6° C.) or higher, which is higher by a predetermined value than the freeze-proof reference outside air temperature, or a predetermined period of time (for example, 60 sec.) elapses. The predetermined period of time is started to be counted when the water inlet temperature becomes the freeze-proof releasing temperature (for example, 6° C.) or higher, which is higher by the predetermined value than the freeze-proof reference water inlet temperature (for example, 3° C.) and the hot water outlet temperature becomes the freeze-proof releasing temperature (for example, 6° C.) or higher, which is higher by the predetermined value than the freeze-proof reference hot water outlet temperature (for example, 3° C.). If it is determined in step S13 that either one temperature is higher, the control routine proceeds to step S14, in which the freeze-proof mode is released. In other words, the bypassing operation is stopped by stopping the water circulating pump 13.

Subsequently, in the case where the freeze-proof mode (1) is not released in step S13, that is, in the case where the outside air temperature is not the freeze-proof releasing outside air temperature or higher and the predetermined period of time does not elapse, the control routine proceeds to step S15. Incidentally, the predetermined period of time is counted by the aforementioned timer means 37 in step S13.

In step S15, it is determined as to whether the water inlet temperature is the low temperature reference value (for example, 1° C.) or lower or the hot water outlet temperature is the low temperature reference value (for example, 1° C.) or lower. Specifically, if either one of the water inlet temperature and the hot water outlet temperature is the low temperature reference value, the control routine proceeds to step S16, in which the freeze-proof mode (2) (i.e., the freeze-proof operation by heating) is started. In contrast, if it is determined in step S15 that the water inlet temperature and the hot water outlet temperature exceed the low temperature reference value, the control routine returns to step S13. Consequently, in the freeze-proof mode (2), the freeze-proof operation by heating can be performed for boiling the water (which has not been heated yet) on the circulating path 12 from the water intake port 10 through the heat exchanging path 14 so as to return the hot water from the hot water inlet 11 to the hot water reservoir tank 3, thereby securely preventing the freezing of the circulating path 12. Furthermore, since the boiled hot water is supplied from the hot water inlet 11 to the hot water reservoir tank 3, it is possible to prevent any decrease in temperature of the hot water on the side of the use, which is taken out through the hot water outlet 6.

After the freeze-proof mode (2) has been started, the control routine proceeds to step S17, in which it is determined as to whether the outside air temperature is the freeze-proof releasing outside air temperature (for example, 6° C.) or higher, which is higher by the predetermined value than the freeze-proof reference outside air temperature, or the predetermined period of time (for example, 60 sec.) elapses, like in step S13. In other words, it is determined as to whether or not the freeze-proof mode (2) is released. If it is determined that the freeze-proof mode (2) is not released, the freeze-proof mode (2) is further continued. In contrast, if it is determined that the freeze-proof mode (2) is released, the control routine proceeds to step S14, in which the freeze-proof mode (2) is released, and then, the control routine returns to step S11.

Although in the above-described preferred embodiment, the freeze-proof mode (1) is started in the case where both of the outside air temperature and the water inlet temperature (or the hot water outlet temperature) are the reference temperature or lower, the freeze-proof mode (1) may be started if the outside air temperature is the freeze-proof reference outside air temperature or lower or the water inlet temperature (or the hot water outlet temperature) is the freeze-proof reference temperature or lower. In this manner, in the case where either one of the temperatures is referred to, the control processing and the like can be simplified. Therefore, in the case where the freeze-proof mode (1) is started, only the outside air temperature, only the water inlet temperature or only the hot water outlet temperature may be used as a criterion. Alternatively, arbitrary two of the above-described three temperatures may be selected, and then, used as criteria. Or, all of the above-described three temperatures may be used as criteria.

Figure 3:
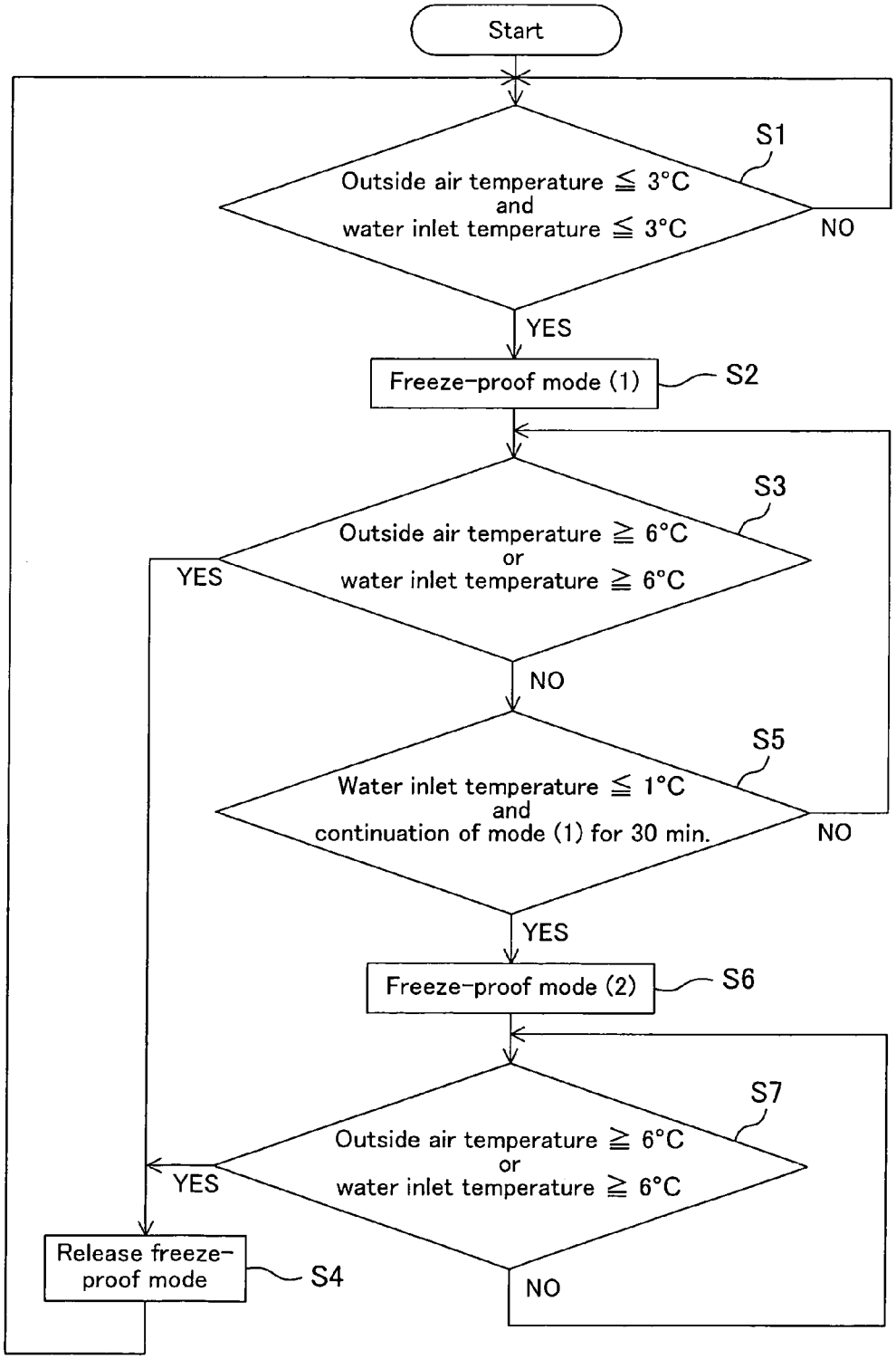
FIG. 3 is a flowchart illustrating an operation control in the heat pump type hot water supplying apparatus.

Furthermore, in the case where the freeze-proof mode is released, that is, in step S3 or step S7 illustrated in FIG. 3, the hot water outlet temperature in place of the water inlet temperature may be used as a criterion. Or, the freeze-proof mode may be released only in the case where the outside air temperature is the freeze-proof releasing outside air temperature or higher and the water inlet temperature and/or the hot water outlet temperature is the freeze-proof releasing temperature or higher.

Moreover, in step S13 or step S17 illustrated in FIG. 4, the freeze-proof mode may be released only when the outside air temperature is the freeze-proof releasing outside air temperature or higher and the predetermined period of time elapses. Additionally, the predetermined period of time is started to be counted in reference to either one of the water inlet temperature and the hot water outlet temperature.

In addition, in step S5 illustrated in FIG. 3, the hot water outlet temperature in place of the water inlet temperature may be used as a criterion. It may be determined based on only the water inlet temperature, only the hot water outlet temperature or only the continuation period of the freeze-proof mode (1), or it may be determined based on the outside air temperature.

Furthermore, in step S15 illustrated in FIG. 4, the control routine may not proceed to step S16 unless both of the water inlet temperature and the hot water outlet temperature are the reference temperature or lower.

Although the description has been given above of the specific preferred embodiment according to the present invention, the present invention is not limited to the above-described preferred embodiment, and therefore, can be embodied in various modifications or alterations within the scope of the present invention.

For example, as the refrigerant may be used refrigerants such as dichlorodifluoromethane (R-12), chlorodifluoromethane (R-22) and 1,1,1,2-tetrafluoroethane (R-134a), or refrigerants for use in a supercritical field such as carbon dioxide, ethylene, ethane and nitride oxide. Here, if the refrigerant is of a type which is used in a supercritical field, the water heat exchanger 26 serves as a gas cooler having the function of cooling a supercritical refrigerant of a high temperature and a high pressure which is compressed by the compressor 25.

Moreover, the freeze-proof reference outside air temperature, the freeze-proof reference temperature (i.e., the freeze-proof reference water inlet temperature and the freeze-proof reference hot water outlet temperature) or the low temperature reference value is determined or set on the basis of the temperature, at which the circulating path 12 may be frozen, it may be varied according to the length or thickness of the pipeline which is used. As a consequence, even if the freeze-proof reference water inlet temperature and the freeze-proof reference hot water outlet temperature are made different from each other, the low temperature reference values for the freeze-proof reference water inlet temperature and the freeze-proof reference hot water outlet temperature may be made different from each other.

Moreover, in step S5 illustrated in FIG. 3, the continuation period (i.e., the continuation period in the freeze-proof operation mode (1)), which is used as the criterion for performing the freeze-proof operation by heating (i.e., the freeze-proof operation mode (2)) by the boiling operation in the heat pump unit, is not limited to 30 min., and thus, it may be varied according to various conditions such as the outside air temperature or the water inlet temperature.

Additionally, in step S13 or S17 illustrated in FIG. 4, the predetermined period of time used as the criterion for releasing the freeze-proof mode is not limited to 60 sec.

In addition, although the hot water is returned from the hot water inlet 11 to the hot water reservoir tank 3 without using the bypassing path 17 in the preferred embodiment in the case where the freeze-proof operation by heating is performed, the hot water may be returned to the hot water reservoir tank 3 via the bypassing path 17.

INDUSTRIAL AVAILABILITY

As described above, the heat pump type hot water supplying apparatus according to the present invention is useful for reserving the hot water in the hot water reservoir tank, and in particular, it is suitably used in the heat pump type hot water supplying apparatus for circulating the reserved water between the hot water reservoir tank and the heat exchanging path.

The invention claimed is:

1. A heat pump type hot water supplying apparatus including a hot water reservoir tank (3), a circulating path (12) for connecting a water intake port (10) formed at the bottom of the hot water reservoir tank (3) and a hot water inlet (11) formed at the upper portion of the hot water reservoir tank (3) to each other, and a water circulating pump (13) and a heat exchanging path (14) which are disposed on the circulating path (12), in which a boiling operation is performed for heating the heat exchanging path (14) by a heat pump type heating source, boiling water which has not been heated yet from the water intake port (10) and returning the heated water to the hot water inlet (11), the heat pump type hot water supplying apparatus characterized in that:

a bypassing path (17) branched from the hot water inlet (11) and connected to the bottom of the hot water reservoir tank (3) is disposed on the circulating path (12); and a freeze-proof operation by circulation is performed such that the water reserved in the hot water reservoir tank (3) is allowed to flow from the water intake port (10) to the circulating path (12) by driving the water circulating pump (13), so as to be returned to the bottom of the hot water reservoir tank (3) via the bypassing path (17) in at least either one case of the case where an outside air temperature is a freeze-proof reference outside air temperature or lower and the case where the temperature of the water through the circulating path (12) is a freeze-proof reference temperature or lower.

2. The heat pump type hot water supplying apparatus of claim 1, characterized in that the freeze-proof operation by circulation is performed when the outside air temperature is the freeze-proof reference outside air temperature or lower and the temperature of the water through the circulating path (12) is the freeze-proof reference temperature or lower.

3. The heat pump type hot water supplying apparatus of claim 1, characterized in that a freeze-proof operation by heating by the use of the heat pump type heating source is performed when the temperature of the water through the circulating path (12) is a low temperature reference value or lower, which is much lower than the freeze-proof reference temperature.

4. The heat pump type hot water supplying apparatus of claim 1, characterized in that a freeze-proof operation by heating by the use of the heat pump type heating source is performed when the temperature of the water through the circulating path (12) is a low temperature reference value or lower, which is much lower than the freeze-proof reference temperature after the freeze-proof operation by circulation is continued for a predetermined period of time.

5. The heat pump type hot water supplying apparatus of any one of claims 1, 3 and 4, characterized in that the freeze-proof operation is stopped in at least either one case of the case where the outside air temperature is a freeze-proof releasing outside air temperature or higher which is higher than the freeze-proof reference outside air temperature and the case where the temperature of the water through the circulating path (12) is a freeze-proof releasing temperature or higher which is higher than the freeze-proof reference temperature.

6. The heat pump type hot water supplying apparatus of any one of claims 1, 3 and 4, characterized in that the freeze-proof operation is stopped in at least either one case of the case where the outside air temperature is a freeze-proof releasing outside air temperature or higher which is higher than the freeze-proof reference outside air temperature and the case where a predetermined period of time elapses after the temperature of the water through the circulating path (12) becomes a freeze-proof releasing temperature which is higher than the freeze-proof reference temperature.

7. The heat pump type hot water supplying apparatus of any one of claims 1, 3 and 4, characterized in that the freeze-proof reference temperature is a temperature with respect to a fore side of the heat exchanging path (14) on the circulating path (12).

8. The heat pump type hot water supplying apparatus of any one of claims 1, 3 and 4, characterized in that the freeze-proof reference temperature is a temperature with respect to a rear side of the heat exchanging path (14) on the circulating path (12).

9. The heat pump type hot water supplying apparatus of any one of claims 1, 3 and 4, characterized in that the freeze-proof reference temperature is set by selecting one of the temperatures with respect to the fore and rear sides of the heat exchanging path (14) on the circulating path (12).

10. The heat pump type hot water supplying apparatus of any one of claims 1, 3 and 4, characterized in that the freeze-proof reference temperature is temperatures with respect to the fore and rear sides of the heat exchanging path (14) on the circulating path (12).

* * * * *